US007086153B2

(12) United States Patent
Yamauchi

(10) Patent No.: US 7,086,153 B2
(45) Date of Patent: Aug. 8, 2006

(54) METHOD AND APPARATUS FOR MANUFACTURING HEAT EXCHANGER TUBE

(75) Inventor: Takumi Yamauchi, Nukata-gun (JP)

(73) Assignee: DENSO Corporation, Kariya (JP)

( * ) Notice: Subject to any disclaimer, the term of this patent is extended or adjusted under 35 U.S.C. 154(b) by 37 days.

(21) Appl. No.: 10/817,375

(22) Filed: Apr. 2, 2004

(65) Prior Publication Data

US 2004/0194943 A1 Oct. 7, 2004

(30) Foreign Application Priority Data

Apr. 3, 2003 (JP) ..... 2003-100342

(51) Int. Cl.
*B21D 53/06* (2006.01)
*B23P 17/00* (2006.01)

(52) U.S. Cl. ..... 29/890.045; 29/413; 29/417

(58) Field of Classification Search ..... 29/890.045, 29/413–417; 225/2, 4, 96.5
See application file for complete search history.

(56) References Cited

U.S. PATENT DOCUMENTS 2,098,989 A * 11/1937 Minter ..... 228/151
2,444,463 A * 7/1948 Nordquist ..... 413/1
2,862,292 A * 12/1958 Lawson ..... 29/413
3,072,770 A * 1/1963 Goodridge ..... 219/612
3,124,872 A * 3/1964 Knodel ..... 29/413
4,283,824 A 8/1981 Schatz et al.
5,407,116 A 4/1995 Nishishita et al.
5,495,972 A 3/1996 Nishishita et al.

FOREIGN PATENT DOCUMENTS

| | | |
|---|---|---|
| GB | 2 203 677 | 10/1988 |
| GB | 2203677 | 10/1988 |
| JP | 63-264218 | 11/1988 |
| JP | 03-124337 | 5/1991 |

* cited by examiner

*Primary Examiner*—Marc Jimenez
(74) *Attorney, Agent, or Firm*—Harness, Dickey & Pierce, PLC

(57) ABSTRACT

Distortion of the cross-sectional shape of a tube when producing a heat exchanger tube by cutting a continuous tube is prevented by forming cutting grooves in a strip material in advance by an upper and bottom cutter. The two side edges of the strip shaped member where stress will concentrate in the next tube forming step, the parts strongly bent, etc. are made thick, while the parts forming the belly surfaces of the tubes are made thin. At least four rollers are divided into two groups and arranged in a zigzag configuration. The continuous tube receives bending force in the forward and reverse directions between the group of rollers and is easily broken at the cutting grooves.

8 Claims, 5 Drawing Sheets

METHOD AND APPARATUS FOR MANUFACTURING HEAT EXCHANGER TUBE

BACKGROUND OF THE INVENTION

1. Field of the Invention

The present invention relates to a method and apparatus for manufacturing a heat exchanger tube, more particularly relates to a method and apparatus for cutting into predetermined lengths a tube formed from a thin strip material made of aluminum, copper, etc. for use in a heat exchanger such as a radiator used for dissipating heat from engine coolant water or a heater used for a vehicular air-conditioning system.

2. Description of the Related Art

As a general method used in the past for cutting into predetermined lengths a long hollow tube formed by the method for rolling a thin strip material from its two side edges to continuously form it into a tubular shape or by extrusion or another method, the method of piercing the tube by a cutter and pushing it through to cut the tube is well known. With this cutting method, cutting scraps corresponding to the width of the cutter are produced, so even if these cutting scraps are smoothly discharged, that much material is wasted. If the cutting scraps are not discharged and remain in the tubes, they will interfere with the flow or cause other problems, so it is necessary to provide a scrap reclaiming means etc. in the cutting apparatus to prevent this. This causes the problem of a swelling cost of disposal of the cutting scraps. Further, with tubes formed with partitions in the long direction for dividing the flow path in the tubes into a plurality of parts so as to improve the heat exchange efficiency, there is the problem that cutting scraps particularly easily are left inside the tubes due to the complicated cross-sectional structure.

To solve this problem, the method has been proposed of using a roll cutter to form cutting grooves in advance in a strip material before formation into a tube, then rolling the strip material to form a tubular shape and pulling the formed tube in the longitudinal direction around the cutting grooves to cause tension and generate a large tensile stress at the parts made thinner by the cutting grooves to thereby separate the tube at the groove parts (see Japanese Unexamined Patent Publication (Kokai) No. 63-264218).

This related art used roll cutters to form V-shaped cutting grooves in advance in a strip material before formation into a tube. If the thickness of the material at the parts provided with the cutting grooves became too small, however, stress would concentrate at those parts when rolling the strip material to form it into a tubular shape—resulting in the formation of poorly shaped tubes in some cases. As opposed to this, when the thickness of the material at the parts provided with the cutting grooves became too great, problems would arise such as separation not being possible at the parts of the cutting grooves even if causing tension to act after formation into a tubular shape or the cross-sectional shape of the tube becoming distorted due to the tube being gripped by a strong force at the time of separation, so in the production of tubes using strip materials of particular small thicknesses, there was the problem that it was difficult to maintain the thickness of the parts formed with the cutting grooves in a suitable range not too small or too large—including the problem of wear occurring at the cutting edges of the roll cutters.

Further, as a method of separation of tubes formed with cutting grooves in advance, it is described in the above publication to arrange a plurality of pairs of shaping rolls in a line from small diameters to large diameters and successively pass a strip material provided with the cutting grooves through these pairs of shaping rolls so as to form it into a tubular shape and cause a tensile force to act on the shaped tube in a direction opening the grooves near the cutting grooves. However, to use this method, it is necessary to strongly grip the tube by the pairs of shaping rolls so as to prevent slippage between the shaping rolls and tube surface. If strongly gripping a tube comprised of a thin material between shaping rolls, there is the problem the shaped tube will end up being crushed.

As another related art, the method has been proposed of cutting into predetermined lengths a continuous tube formed into a tubular shape in advance by a prior processing apparatus by using a disk cutter to form cutting grooves in the surface of the tube at the initial step, then gripping a part before a groove by a fixed clamp at the next step and gripping the part after the groove by a movable clamp and rocking it largely in an arcuate shape to bend a predetermined length of the tube and break it off from the following tube part at the cutting groove part (see Japanese Unexamined Patent Publication (Kokai) No. 3-124337).

With this cutting method, however, a disk cutter is used to form cutting grooves at the continuous tube formed into a tubular shape in advance, so in the same way as the above prior art, it is difficult to control the depth of the cutting grooves or the thickness of the material remaining at the parts of the cutting grooves to the optimal ranges. If the thickness of the groove parts becomes too great, the problem may arise of the cross-sectional shape of the tube deforming when bending the tube to break it off. Further, it is necessary to provide a fixed clamp and a movable clamp for rocking with respect to the same for breaking off the tube at the cutting grooves. Therefore, due to the range of rocking of the predetermined length of tube and the size of the space occupied by the device for driving the movable clamp, the cutting apparatus as a whole becomes large in size and complicated in structure. Due to this, a rise in the cost of the cutting step is unavoidably invited.

SUMMARY OF THE INVENTION

An object of the present invention is to eliminate the above problems by a novel means.

To attain the above object, the present invention provides a method of manufacturing a heat exchanger tube obtaining tubes of predetermined lengths by a step of forming cutting grooves in advance in a strip material at predetermined intervals, a step of rolling the strip material into a tubular shape to form a continuous tube, and a step of separating the continuous tubes at the cutting grooves by applying external force to parts of the continuous tube, wherein, when forming the cutting grooves in advance in the strip material, thin parts (first parts) and thick parts (second parts) are formed in the cutting grooves. Note that in the present invention, the terms "cutting" and "cut" are used in the sense of general separation of a material into a plurality of parts by application of external force, that is, in the sense of "breaking" or "break".

By using the method of manufacture of the present invention, unintentional breakage of the strip material at the cutting grooves when rolling the strip material formed with cutting grooves so as to form it into a tubular shape is prevented by the provision of the thick parts (second parts) at suitable locations of the cutting grooves. Further, breakage of the continuous tube at the positions of the cutting grooves after being shaped into the continuous tube is facilitated by the provision of the thin parts (first parts) at suitable locations of the cutting grooves. Accordingly, the strip material will no longer be cut or torn when being shaped into a tube, so the cross-sectional shape of the continuous tube will not become distorted. Further, when cutting the continuous tube at the cutting grooves, distortion of the cross-sectional shape can be prevented and therefore high quality tubes can be cut smoothly and speedily.

As the "suitable locations for forming the thick parts", it is possible to select the two edges of the strip material where stress is liable to concentrate in the step of forming a continuous tube from the strip material, the parts forming the two side edges of the tube when the strip material is bent, the parts resistant to deformation when external force is applied in the step of separating the continuous tube, etc. Further, the "suitable locations for forming the thin parts" may be made parts where stress does not easily concentrate such as parts of the strip material ending up forming the belly surfaces of the tube.

To cut the continuous tube formed with the cutting grooves at predetermined intervals in advance at the positions of the cutting grooves by application of external force, the method of passing the continuous tube through at least four rollers arranged in a zigzag configuration and divided into two groups may be adopted. In this case, the two groups of rollers are set apart by a distance slightly smaller than the short diameter of the continuous tube. The continuous tube is made to undulate when passing between the two groups of rollers. Accordingly, the continuous tube receives forward and reverse bending forces at the cutting grooves. As a result, it can be easily and smoothly broken at the cutting grooves. Note that the ends of the heat exchanger tubes after breakage are left with traces of the thin parts (first parts) and thick parts (second parts) of the grooves—although short in lengths.

The present invention also provides, as another means for achieving the object, an apparatus for manufacturing a heat exchanger tube which applies external force at parts of a continuous tube formed with cutting grooves in advance at predetermined intervals so as to separate the continuous tube at the cutting grooves by providing at least four rollers arranged in a zigzag configuration, the rollers being divided into two groups and the distance between the two groups of rollers being set slightly smaller than the short diameter of the continuous tube, and by passing the continuous tube between the two groups of rollers. In this apparatus, the continuous tube formed in advance with the cutting grooves undulates while being tilted slightly in the forward and reverse directions when being passed between the two groups of rollers. Therefore, the continuous tube receives forward and reverse direction bending forces at the cutting grooves, so breaks at the cutting grooves, whereby the continuous tube is separated into predetermined lengths.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

Figure 1:
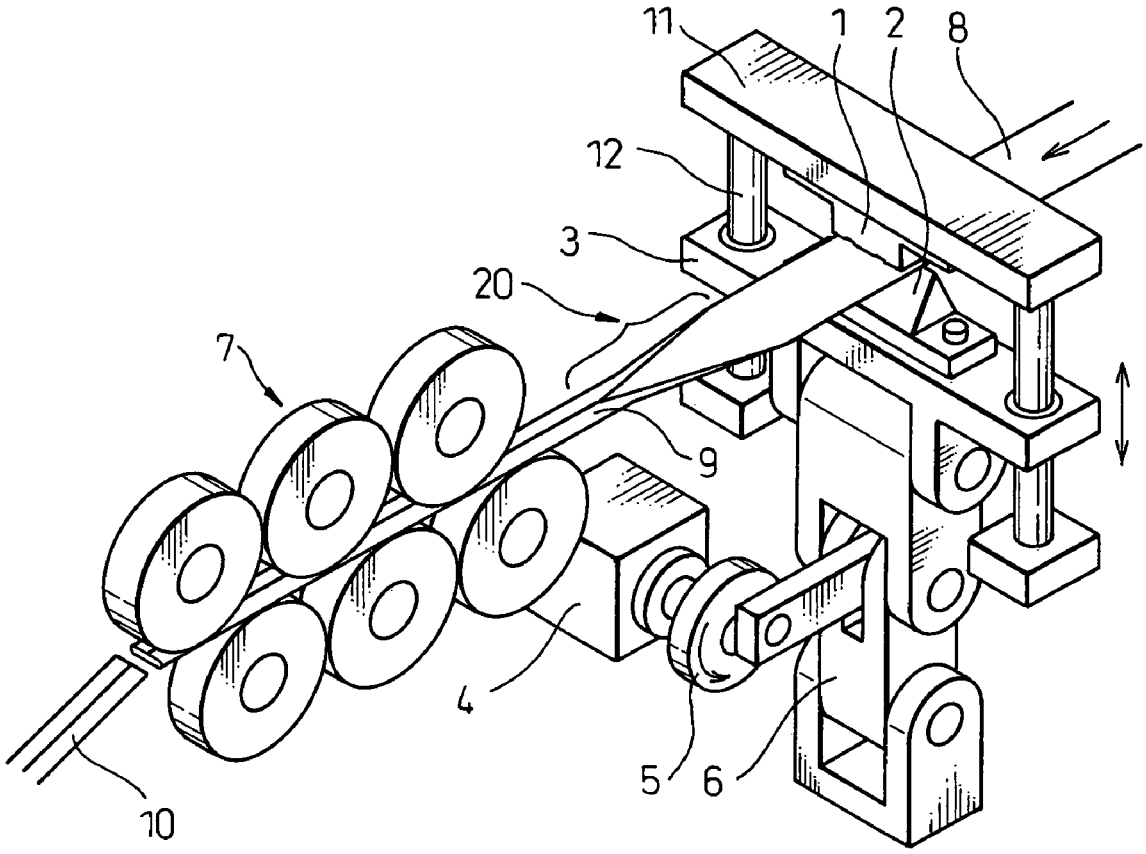
FIG. 1 is a perspective view illustrating principal parts of an apparatus for producing a heat exchanger tube used in the method of the present invention.

First, a preferred embodiment of a method of manufacturing a heat exchanger tube according to the present invention will be explained in detail while referring to FIG. 1 to FIG. 6 among the attached figures. FIG. 1 shows principal parts of a manufacturing apparatus used for this method of manufacture. Reference numeral 1 indicates a top cutter which is fixedly supported by a top plate 11 of guide posts. Reference numeral 2 is a bottom cutter which is attached to a vertical slider 3 and can be moved integrally with it vertically along two parallel guide posts 12. Reference numerals 4 to 6 are parts forming the drive mechanism for vertical movement of the bottom cutter 2 and the vertical slider 3, wherein 4 indicates a drive device with a not shown built-in motor or speed reducer, 5 indicates an eccentric wheel attached to a drive shaft of the drive device 4, and 6 indicates a toggle-shaped link mechanism linking an eccentric pin of the eccentric wheel 5 and the vertical slider 3 and comprised of a plurality of link arms and pivot pins etc. Note that the drive mechanism of the illustrated embodiment may be replaced with another mechanism operating in the same way.

Reference numeral 7 indicates a group of tube separation rollers. In the embodiment shown in FIG. 1, it is comprised of three rollers of the same diameters at the top and at the bottom. The three top rollers and the three bottom rollers are arranged offset by half radii, so the group of rollers 7 exhibits a zigzag configuration as a whole. The group of rollers 7 is rotatably supported by a not shown frame and bearings so that a distance slightly smaller than the short diameter of the final tube is formed between the group of the three top rollers and the group of the three bottom rollers in the vertical direction, that is, the direction perpendicular to the direction of flow of the continuous tube 9. The rollers forming the group of rollers 7 are all driven at the same speed by a not shown drive device, but needless to say the rotational directions become opposite between those above the continuous tube 9 and those below it. Note that depending on the configuration of the device for feeding the continuous tube 9 into the groups of rollers 7 for tube separation, sometimes the rollers of the group of rollers 7 do not have to be driven to rotate.

The strip material 8, comprised of aluminum, copper, etc., is for example unwound from a coil and fed as shown by the arrow to a cutter mechanism comprised of the top cutter 1 and the bottom cutter 2. While not shown, a tube forming step 20 for rolling the strip material 8 from its two side edges to continuously form it into a tubular shape is provided between the cutter mechanism and the group of tube separation rollers 7. The tube forming step 20 itself is not a characterizing feature of the present invention, so it is possible to use any suitable processing apparatus having a configuration meeting with this object. Therefore, the strip material 8 is passed through the tube forming step 20 to be formed into a continuous tube 9, then is passed between the group of tube separation rollers 7 to be cut into predetermined lengths of tubes 10.

Figure 2:
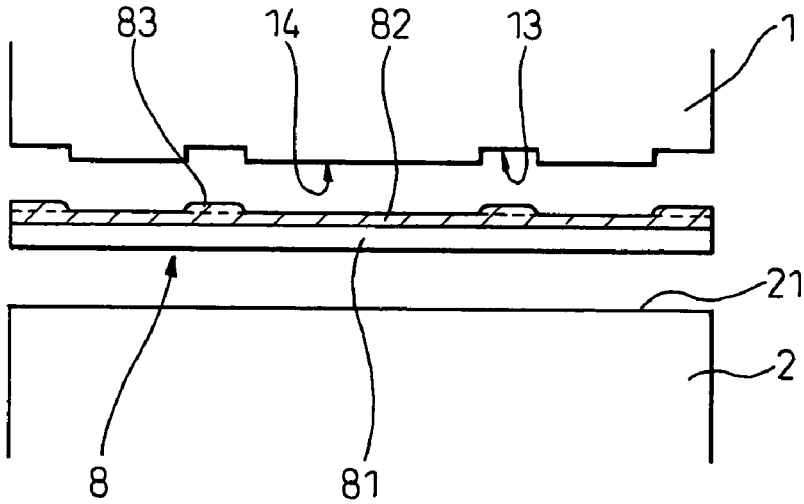
FIG. 2 is a front view of a top cutter and bottom cutter and a strip material.
Figure 3:
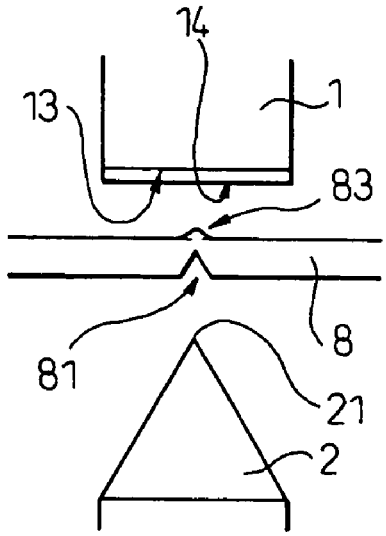
FIG. 3 is a side view of the same objects as in FIG. 2.

The detailed structures of the top cutter 1 and the bottom cutter 2 forming the cutter mechanism in the manufacturing apparatus of the illustrated embodiment are shown in FIG. 2 and FIG. 3. The top cutter 1 is plate shaped overall, but, as shown in FIG. 2, is provided with notch-shaped thick part forming recesses 13 at the bottom surface at the two ends and two predetermined positions in the middle, that is, a total of four locations. The rest of the bottom surface other than the thick part forming recesses 13 forms flat surfaces 14 with the same widths as the thickness of the top cutter 1.

As opposed to this, the bottom cutter 2, as shown in FIG. 3, has a wedge-like cross-sectional shape and provides a sharp edge 21 at its top surface across the entire width. As shown in FIG. 2, the edge 21 is formed straight without any relief shapes.

When the bottom cutter 2 rises from below toward the fixed top cutter 1 by being driven the drive device 4 through the eccentric wheel 5 and link mechanism 5 etc., the strip material 8 supplied between them is clamped and the elastically deforms to the shape as shown in FIG. 2 and FIG. 3. That is, part of the bottom surface of the strip material 8 is pressed by the bottom cutter 2 whereby a cutting groove 81 is formed over the entire width of the strip material 8. At this time, however, the depth of the cutting groove 81 is set smaller than the thickness of the strip material 8 so that the bottom cutter 2 does not cut apart the strip material 8. The interval between the adjoining cutting grooves 81 in the longitudinal direction of the strip material 8 is set to become substantially the same as the length of the tubes 10 of the finished products by adjusting the feed rate of the strip material 8 and the cycle of repeated rising of the bottom cutter 2.

When the bottom cutter 2 rises as explained above and the cutting groove 81 is formed in the strip material 8, almost all of the part of the top surface of the strip material 8 contacting the top cutter 1 is supported by the flat surfaces 14 forming the majority of the bottom surface of the top cutter 1, so at the parts of the strip material 8 clamped between them, thin parts 82 of smaller thicknesses corresponding to the majority of the cutting groove 81 are formed in a broken line. At the intervals between the thin parts 82 arranged in the broken line, four thick parts 83 are formed by the thick part forming recesses 13 of the top cutter 1 so as to stick out upward from the top surface of the strip material 8. Note that the "thick parts" mean parts thicker than the thin parts 82. The thicknesses of the thick parts 83 are not particularly greater than the original thickness of the strip material 8.

In this way, when forming the cutting grooves 81 in advance in the strip material 8, the thickness of the strip material 8 remaining at those parts by the formation of the cutting grooves 81 is not made uniform. One of the characterizing features of the present invention is the separate formation of thin parts 82 where relatively small thicknesses are left by the cutting grooves 81 and thick parts 83 where relatively large thicknesses are left by the cutting grooves 81. Therefore, an explanation will be made of what parts of the cutting grooves 81 the thin parts 82 should be formed at and what parts of the cutting grooves 81 the thick parts 83 should be formed at.

First, the thin parts 82 are formed at parts of the cutting grooves 81 resistant to concentration of stress and with relatively little change of the cutting grooves 81 breaking when rolling the strip material 8 from the two side edges into a tubular shape to form a continuous tube 9 in the next step. Further, as explained later, the thin parts 82 are formed for the purpose of assisting breakage at the final step at the parts of the cutting grooves 81 easily deforming upon application of external force and easily being left with strain in the cross-sectional shape of the product when applying external force to the continuous tube 9 to break it at the positions of the cutting grooves 81 in the final step.

Next, at the next step of forming the cutting grooves 81 in the strip material 8, the thick parts 83 are formed at the parts of the cutting grooves 81 liable to break due to concentration of stress when rolling the strip material 8 from the two side edges into a tubular shape to form a continuous tube 9. Further, as explained later, the thick parts 83 are formed at the parts of the cutting grooves 81 resistant to deformation even with application of external force and with little liability of strain remaining in the cross-sectional shape of the product when applying external force to the continuous tube 9 to break it at the positions of the cutting grooves 81 in the final step.

Figure 4:
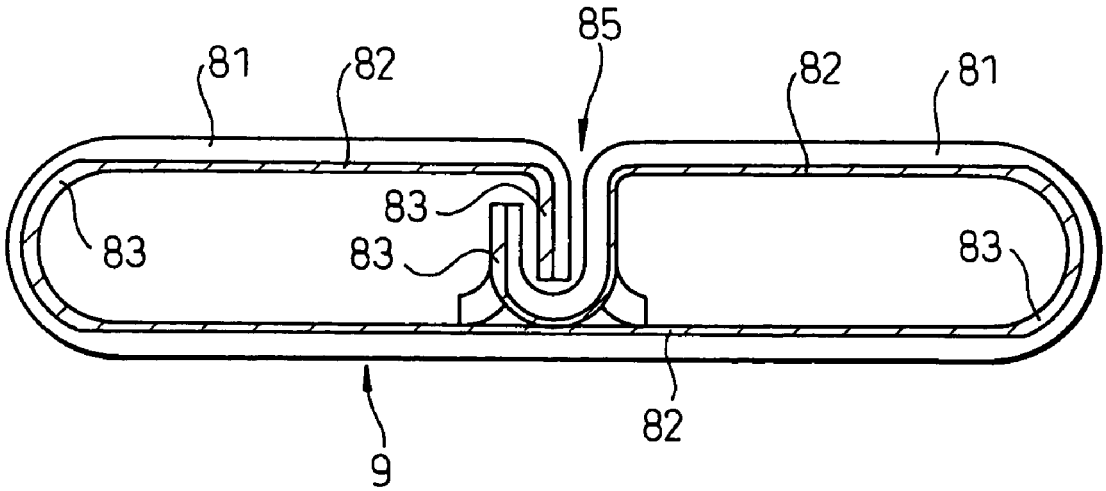
FIG. 4 is a cross-sectional view illustrating the cross-sectional shape of a tube.
Figure 5:
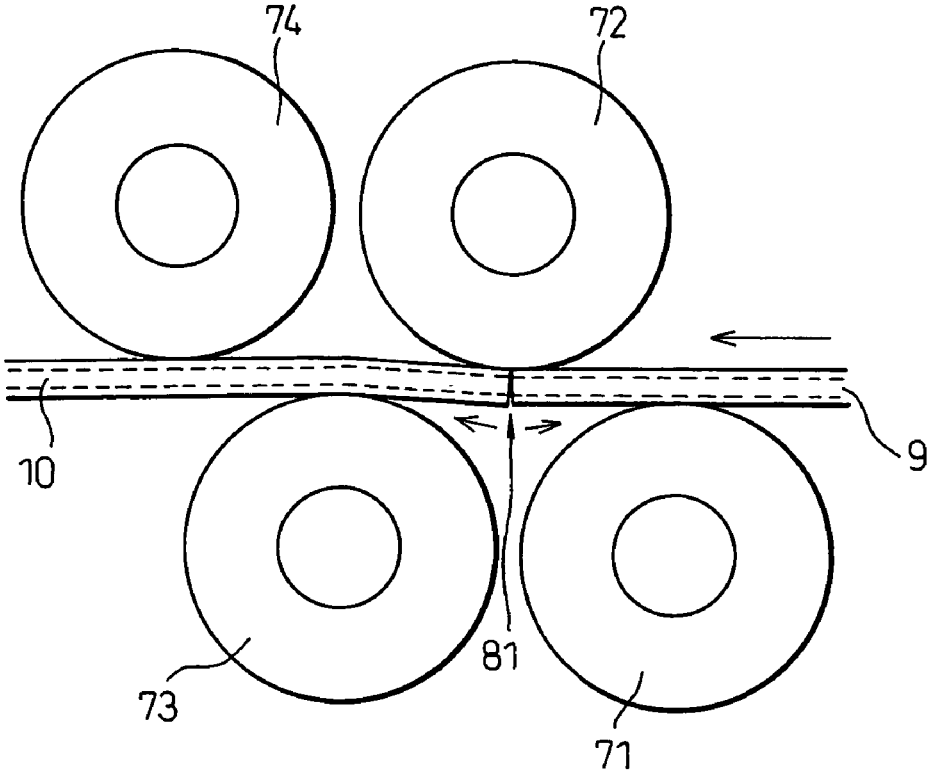
FIG. 5 is a side view enlarging part of the group of tube separation rollers.

The specific system configuration of the tube forming step 20 is not a characterizing feature of the present invention so is not shown, but the strip material 8 formed with the cutting grooves 81 at predetermined intervals by the previous cutter mechanism is rolled into a tubular shape from the two side edges to form the continuous tube 9. The cross-sectional shape of the tube 9 is illustrated in FIG. 4. According to the method of the present invention, the continuous tube 9 is separated into tubes 10 of predetermined lengths by being broken at the positions of the cutting grooves 81 when passed through the group of tube separation rollers 7. The cross-sectional shape does not change at that time, so the cross-sectional shape shown in FIG. 4 also shows the cross-sectional shape of a tube 10 of the final product after separation by the group of tube separation rollers 7.

The continuous tube 9 formed by the tube forming step 20, in the case of the present embodiment, has an overall flat cross-sectional shape as shown in FIG. 4, so if forming the continuous tube 9 from a strip material 8 formed with cutting grooves 81 left with thin parts 82 and thick parts 83 as explained above, the thin parts 82 of the cutting grooves 81 will form parts of the upper and lower belly surfaces with little liability of concentration of stress during formation and easily deforming and left with strain when external force is applied in the final separation step.

The thick parts 83 of the cutting grooves 81 become parts where stress is liable to concentrate and the cutting grooves 81 will easily break at the time of formation, that is, the two side edges of the strip material 8 where large stress will concentrate when rolling the strip material 8 into a tubular shape at the start of formation and where the left and right parts overlap to form the joint 85 in the end and the two side edges of the tube where large bending stress will occur when the continuous tube 9*s* is bent in cross-sectional shape.

Therefore, the positions of the thick part forming recesses 13 of the top cutter 1 are set so that the thick parts 83 and thin parts 82 are formed at their targeted positions on the strip material 8. Note that the joint 85 is completely joined by soldering etc. after the tube 10 is produced or after the tube 10 is assembled in a not shown heat exchanger.

Next, when the continuous tube 9 having the cross-sectional shape illustrated in FIG. 4 is fed from the tube forming step 20 to the group of tube separation rollers 7, since the group of rollers 7 form a zigzag configuration and since the distance in the vertical direction between the group of top rollers and the group of bottom rollers is set to be slightly smaller than the short diameter of the tube 9, that is, the dimension in the vertical direction, the continuous tube 9 will be forced to undulate by a small amplitude when passing through the group of rollers 7. Therefore, when a cutting groove 81 reaches the position shown in FIG. 5, the continuous groove 9 will be pushed down by the second cutting roller 72 between the first cutting roller 71 and the third cutting roller 73, so the continuous tube 9 will receive a bending force making it bend downward and will break at the cutting groove 81 at its bottom surface.

Figure 6:
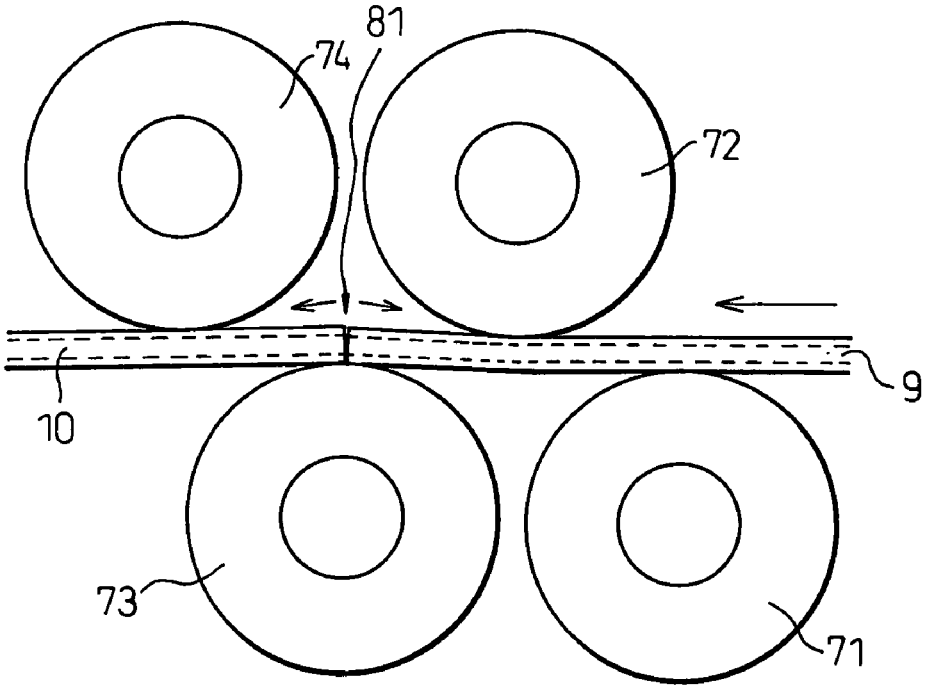
FIG. 6 is a side view of a different state for the same objects as in FIG. 5.

Next, when the cutting groove 81 reaches the position shown in FIG. 6, the continuous tube 9 will be pushed up by the third cutting roller 73 between the second cutting roller 72 and the fourth cutting roller 73, so the continuous tube 9 will receive a bending force making it bend upward and will break at the cutting groove 81 at its top surface.

Further, since the cutting grooves 81 are also formed at the two side edges of the continuous tube 9 and the positions of the thick part 83 of the joint 85, when the upper and lower cutting grooves 81 of the continuous tube 9 are broken by the forward and reverse bending forces at the belly surfaces, the thick parts 83 at the two side edges and the joint 85 will also crack and break in the vertical direction. Even if a part turns up which will not break by first forward and reverse bending actions, it is possible to increase the number of rollers of the group of rollers 7 so as to applying repeated bending actions a second or third time so that the continuous tube 9 is reliably broken at the position of the cutting grooves 81.

In this way, the tube 9 is simply broken by just applying forward and reverse bending forces to the tube 9 at the position of a cutting groove 81 by the group of tube separation rollers 7, so the problem like in the related art of the tube being crushed and the cross-sectional shape being distorted due to the continuous tube being clamped by a strong force before and after a cutting groove for application of tension will not occur. Further, compared with other related art of clamping the front end of the tube by a movable clamp and rocking it greatly so as to promote breakage at the cutting groove, it is possible to make the apparatus used small in size and lower in cost. Further, the flow of the continuous tube 9 at the group of tube separation rollers 7 becomes smooth, so the speed of not only the separation step of the continuous tube 9, but also the entire process of production of the heat exchanger tubes can be increased.

Figure 7:
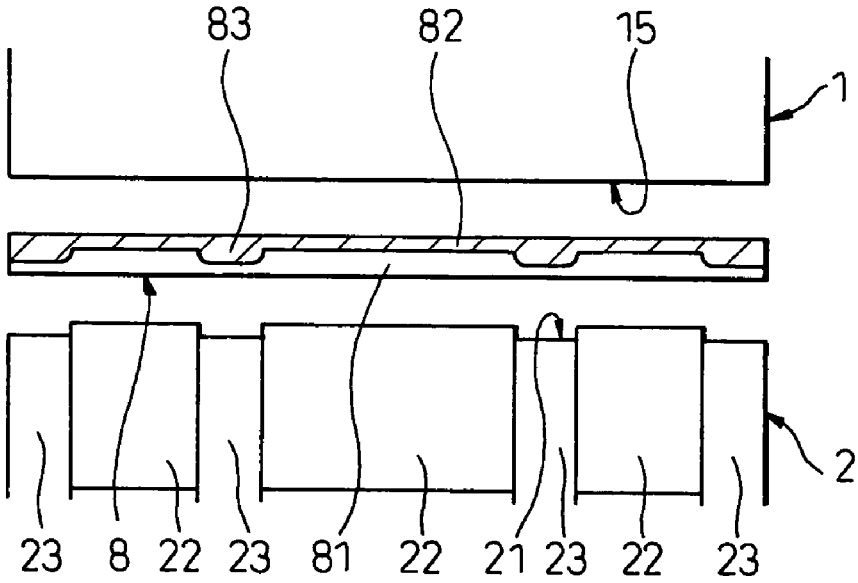
FIG. 7 is a front view of an example different from FIG. 2.
Figure 8:
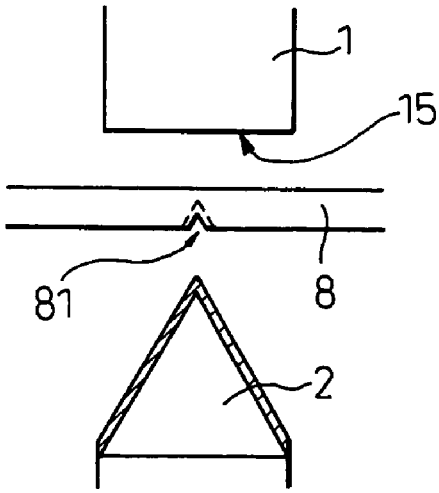
FIG. 8 is a side view of the same objects as in FIG. 7.

FIG. 7 and FIG. 8 show another example of the present invention. As will be clear from a comparison of these figures with FIG. 2 and FIG. 3 explained in the above example, the top cutter 1 in this example is not formed with shapes like the thick part forming recesses 13 and therefore the entire bottom surface forms a flat surface 15. The bottom cutter 2 has a general wedge like cross-sectional shape. The wedge surface is alternately formed with projecting parts 22 and recessed parts 23 in the longitudinal direction, that is, the width direction when seem from the strip material 8. The top sides of the projecting parts 22 and recessed parts 23 are provided with sharp edges 21 over their entireties. These projecting parts 22 and recessed parts 23 are for forming thin parts 82 and thick parts 83 similar to those explained above, so their lengths are determined in accordance with the cross-sectional shape of the continuous tube 9 shown in FIG. 4 and the target tube 10.

If using a top cutter 1 and a bottom cutter 2 of such shapes for the cutter mechanism, as shown in FIG. 7 and FIG. 8, a strip material 8 of a shape with thick parts 83 partially sticking out in the cutting grooves 81 formed by the bottom cutter 2 will be obtained. In this way, even with a strip material having a cross-sectional shape such as shown in FIG. 7 and FIG. 8, an action similar to the strip material 8 with a cross-sectional shape shown in FIG. 2 and FIG. 3 can be obtained. Therefore, the action and effect of this example are generally the same as those explained above. Note that it is also possible to make a top cutter 1 and a bottom cutter 2 partially combining the features of FIG. 2 and FIG. 3 and the features of FIG. 7 and FIG. 8.

Figure 9:
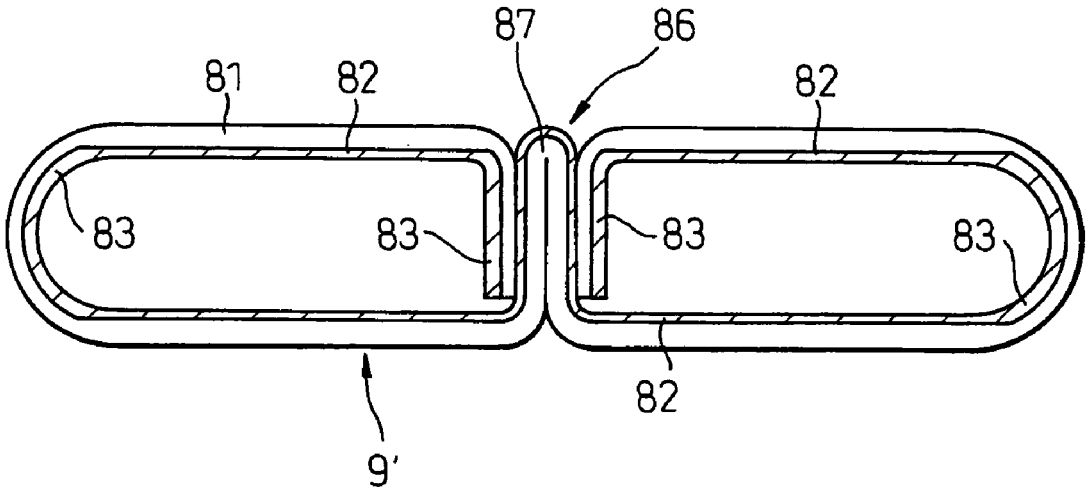
FIG. 9 is a cross-sectional view of the cross-sectional shape of a tube different from FIG. 4.

A modification of the cross-sectional shape of the continuous tube 9 shown in FIG. 4 is shown as the continuous tube 91 in FIG. 9. According to the method of the present invention, the cross-sectional shape is substantially the same as that of the tube 10 of the final product. This change in the cross-sectional shape of the tube not only has reverberations on the question of how to shape the top cutter 1 and bottom cutter 2, but also on the question of how to roll the strip material 8 into a tubular shape at the tube forming step 20, so also has repercussions on the details of the step 20, but the present invention is not characterized by the details of the tube forming step 20 itself. Therefore, the details of the step 20 will be omitted and only the cross-sectional shape of the tube 9' turned out will be shown.

As clear from a comparison of FIG. 9 and FIG. 4, the continuous tube 9' shown in FIG. 9 is characterized by the shape of the joint 86. The two side edges of the strip material 8 are bent equally and symmetrically left and right and overlap with a wall fold 87 formed in the longitudinal direction at the center part of the strip material 8 in the width direction. Therefore, the positions of the cutting grooves 81 and the thick parts 83 in the width direction of the strip material 8 will differ from those shown in FIG. 4, so the shapes of the top cutter 1 and bottom cutter 2 for forming them will also differ. However, the actions and effects of this example are generally the same as explained above.

Figure 10:
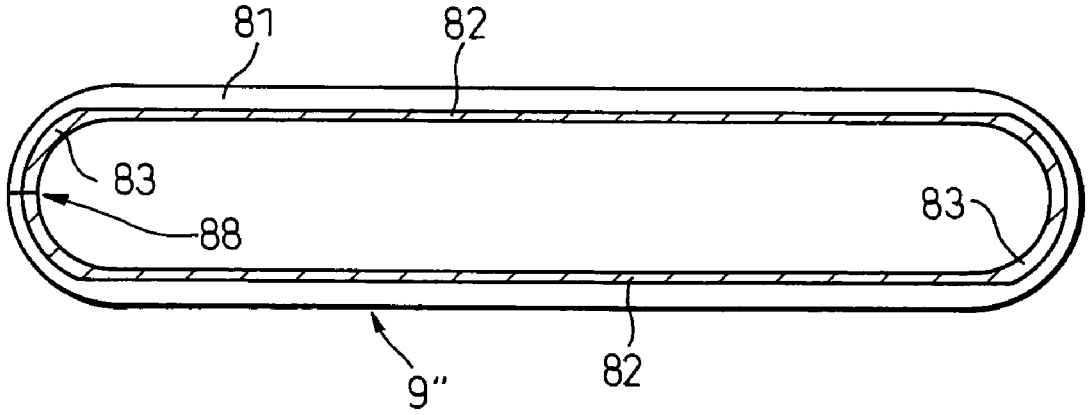
FIG. 10 is a cross-sectional view of the cross-sectional shape of a tube different from FIG. 4 and FIG. 9.

From a similar viewpoint, FIG. 10 shows still another example of the cross-sectional shape of the continuous tube. In this case, the joint 88 formed at the part where the two side edges of the rolled up strip material 8 are made to abut each other is provided leaning to either the left or right side edge of the cross-sectional shape of the continuous tube 9". There is no partition inside the continuous tube 9", so just a single flow path is formed. Accordingly, this example is in a sense inferior to the previous examples in terms of the heat exchange efficiency and mechanical strength, but there are the advantages that the structure is simple and the flow path is resistance to blockage, so this is suitable for a radiator used for dissipating heat of engine coolant water etc.

While the invention has been described with reference to specific embodiments chosen for purpose of illustration, it should be apparent that numerous modifications could be made thereto by those skilled in the art without departing from the basic concept and scope of the invention.

What is claimed is:

1. A method of manufacturing a plurality of heat exchanger tubes each having a predetermined length, the method comprising:

providing a strip material having a specified width;

forming a plurality of cutting grooves in the strip material, each cutting groove extending entirely across the specified width and being spaced by the predetermined length, each cutting groove including at least two thin parts separated by a thick part;

rolling the strip material into a tubular shape to form a continuous tube;

separating the continuous tube at each cutting groove by applying external force to parts of the continuous tube; wherein applying the external force to parts of said continuous tube comprises passing said continuous tube between at least four rollers arranged into two groups so as to have one group of rollers offset in a movement direction of the strip material from one other group of rollers, and set to a distance between the two groups of rollers slightly smaller than a short diameter of said continuous tube so as to make said continuous tube undulate between said two groups of rollers.

2. A method of manufacturing a plurality of heat exchanger tubes as set forth in claim 1, wherein said thick parts are formed at parts of said cutting grooves where stress concentrates in said rolling step.

3. A method of manufacturing a plurality of heat exchanger tubes as set forth in claim 2, further comprising forming additional thick parts at parts of said cutting grooves formed at the two side edge parts of said strip material.

4. A method of manufacturing a plurality of heat exchanger tubes as set forth in claim 2, wherein said thick parts are formed at parts of said cutting grooves formed at parts of said strip material which will be bent to form two side edges of the tube.

5. A method of manufacturing a plurality of heat exchanger tubes as set forth in claim 1, wherein said thick parts are formed at parts of said cutting grooves hard to deform when external force is applied in said step of separating said continuous tube.

6. A method of manufacturing a plurality of heat exchanger tubes as set forth in claim 1, wherein said thin parts are formed at parts of said cutting grooves formed at parts of said strip material ending up becoming belly surfaces of the tubes.

7. A method of manufacturing a plurality of heat exchanger tubes each having a predetermined length, the method comprising:

providing a strip material having a specified width;

forming a plurality of cutting grooves in the strip material, each cutting groove extending entirely across the specified width and being spaced by the predetermined length, each cutting groove including differences in the thickness of the strip material are provided at the cutting groove at different positions along the specified width;

rolling the strip material into a tubular shape to form a continuous tube;

separating the continuous tube at each cutting groove by applying external force to parts of the continuous tube.

8. A method of manufacturing a plurality of heat exchanger tubes each having a predetermined length, the method comprising:

providing a strip material having a specified width;

forming a plurality of cutting grooves in the strip material, each cutting groove extending entirely across the specified width and being spaced by the predetermined length, each cutting groove including at least two thin parts separated by a thick part;

rolling the strip material into a tubular shape to form a continuous tube;

separating the continuous tube at each cutting groove by applying external force to parts of the continuous tube.

* * * * *